United States Patent [19]

Higgins

[11] 4,155,859

[45] May 22, 1979

[54] FORGING LUBRICANTS AND METHOD OF USE THEREOF

[75] Inventor: William A. Higgins, Gates Mills, Ohio

[73] Assignee: The Lubrizol Corporation, Wickliffe, Ohio

[21] Appl. No.: 870,688

[22] Filed: Jan. 19, 1978

[51] Int. Cl.[2] ..... C10M 3/18; C10M 5/14; C10M 7/20; C10M 7/24

[52] U.S. Cl. ..... 252/22; 72/42; 252/29

[58] Field of Search ..... 252/22, 29; 72/42

[56] References Cited

U.S. PATENT DOCUMENTS

| | | | |
|---|---|---|---|
| 3,242,079 | 3/1966 | McMillen | 252/18 |
| 3,492,231 | 1/1970 | McMillen | 252/18 |
| 3,801,504 | 4/1974 | Stone | 252/23 |
| 3,806,453 | 4/1974 | McDole | 252/22 |
| 3,925,214 | 12/1975 | Livingston et al. | 252/21 |
| 3,931,020 | 1/1976 | Burgess et al. | 252/30 |
| 4,052,323 | 10/1977 | Feneberger et al. | 252/22 |
| 4,071,368 | 1/1978 | Jones | 252/30 |

FOREIGN PATENT DOCUMENTS

| | | | |
|---|---|---|---|
| 2718780 | 11/1977 | Fed. Rep. of Germany | 252/33 |

*Primary Examiner*—Delbert E. Gantz
*Assistant Examiner*—Irving Vaughn
*Attorney, Agent, or Firm*—James W. Adams, Jr.; William H. Pittman

[57] ABSTRACT

Compositions suitable for use as forging lubricants, especially for hot forging, comprises an aliphatic or alicyclic organic diluent (preferably one which has a high flash point and a relatively high boiling point), graphite and non-Newtonian basic alkaline earth metal complex. The complex is preferably a grease-like or gel-like basic calcium or magnesium sulfonate or carboxylate, or mixture thereof. Basic magnesium sulfonate-carboxylates are especially preferred. These lubricants, when used in hot forging operations, are characterized by their ability to protect the forging die from welding, scoring or other deformation and by their relatively smokeless properties.

23 Claims, No Drawings

FORGING LUBRICANTS AND METHOD OF USE THEREOF

This invention relates to new compositions of matter useful as lubricants for hot forging of metals, and to a method of hot forging of metals in which such compositions are used. In particular, one aspect of the present invention is a composition comprising (A) a substantially inert, relatively non-volatile, normally liquid aliphatic or alicyclic organic diluent and, dissolved or stably suspended therein, (B) graphite and (C) at least one non-Newtonian basic alkaline earth metal complex; the graphite comprising up to about 25% and the alkaline earth metal complex about 5–25% by weight of said composition.

In the hot forging of metal workpieces, the workpiece is heated to a temperature on the order of 1,000°–1,200° C. and is squeezed or hammered between two dies to form the workpiece into the desired shape. The temperature of the die during forging may be as high as about 450° C. At such high temperatures, the workpiece can become welded to the die or score its surface if some means is not used to keep the two separated and the die lubricated. It is customary to apply to the die a lubricant which, while being for the most part evaporated and/or burned off when the hot workpiece is contacted, nevertheless protects the die against welding, scoring and other deformation.

Because of the high temperatures involved, the selection of a suitable forging lubricant is a considerable challenge. In particular, it is necessary to choose a lubricant which, while performing satisfactorily, does not evolve excessive smoke or other polluting or noxious fumes or pyrolysis by-products at forging temperatures. The avoidance of pollutant formation is important both from the standpoint of safety of the workers in the forging plant and from the standpoint of avoiding pollution of the air outside the plant, such as through smokestacks. The latter has become increasingly important in recent years with the emphasis being placed on clean air in metropolitan areas and elsewhere.

Many common forging lubricants are water-based. They ordinarily contain graphite as the material which provides the actual lubricant properties, the aqueous base and other relatively volatile materials being driven off by evaporation or thermal decomposition. In many instances, however, such lubricants are inadequate because of the high volatility of the aqueous liquid used to suspend the graphite. Interest has therefore turned to the use of relatively non-volatile organic lubricants as diluents for forging lubricants. It is in the area of predominantly organic hot forging lubricants that the present invention finds its application.

A principal object of this invention is to provide improved forging lubricants comprising predominantly organic materials.

A further object is to provide lubricants useful in forging operations which are relatively smokeless and non-polluting.

Still another object is to provide a method for forging in which such useful lubricants are used.

Other objects will in part be obvious and will in part appear hereinafter.

The lubricant compositions of the present invention comprise three essential ingredients, one of which (component B) is graphite. Graphite is a common constituent of forging lubricants, whether suspended in water or in an organic liquid.

A second essential ingredient (component A) is a substantially inert, relatively non-volatile, normally liquid aliphatic or alicyclic organic diluent. By "substantially inert" as used herein is meant a liquid which, under forging conditions, does not corrode the metal being forged or the forging die or decompose other constituents of the lubricant at temperatures up to and including forging temperatures, and which is also inert to chemical and physical change at lower temperatures so that it does not materially interfere in an adverse manner with the preparation, storage and blending of the compositions of this invention. For example, small amounts of a diluent can undergo minimal reaction or degradation without preventing the making and using of the invention as described herein. In other words, such reaction or degradation, while technically discernible, would not be sufficient to deter the practical worker of ordinary skill in the art from making and using the invention for its intended purposes. "Substantially inert" as used herein is, thus, readily understood and appreciated by those of ordinary skill in the art.

Materials suitable as organic diluents in the compositions of this invention may include aliphatic and alicyclic hydrocarbons, alcohols, ketones, ethers, ether alcohols and the like, as well as mixtures of these. Aromatic compounds are not suitable for use as the sole diluent, and their presence in the diluent should be kept below about 20% (by weight) and preferably below about 10% because of their tendency to smoke when burned or decomposed. Hydrocarbons, especially mineral oils such as kerosene and heavy mineral oils, are particularly useful because of their inertness and relative odorlessness; other suitable diluents may include stearyl alcohol, methyl triacontanyl ketone, Methyl Carbitol and the like. The preferred diluents are those having flash points above about 150° C. and usually above about 175° C. when measured by the Cleveland Open Cup Method (ASTM Method D92). Liquids having a 50% distillation point at 1 torr, as measured by ASTM Method D1160, above about 200° C. and particularly above about 220° C. are especially preferred, and a still greater preference is expressed for non-polar liquids of this type, notably hydrocarbons such as 200 to 650 neutral mineral oil, bright stock, and mixtures of the same.

Component C in the compositions of this invention is at least one non-Newtonian basic alkaline earth metal complex. Such complexes are known in the art and are described, for example, in U.S. Pat. Nos. 3,242,079; 3,492,231; and 4,094,801, all of which are incorporated by reference herein for their disclosures of such complexes.

One method of preparing component C, described in the aforementioned U.S. Pat. Nos. 3,242,079 and 3,492,231, involves first preparing an oil-soluble, basic alkaline earth metal salt or complex and subsequently converting it to a non-Newtonian complex. Oil-soluble salts and complexes, frequently referred to as "overbased," "superbasic" or "hyperbasic" materials, are also well known in the art and are disclosed in many United States patents of which the following are exemplary:

U.S. Pat. Nos. 2,616,904; 2,695,910; 3,312,618; 3,350,308; 3,629,109; 3,746,643 and 3,764,533.

The above patents are incorporated by reference herein for their disclosures of oil-soluble basic salts and complexes. The salts and complexes useful in the present invention include those disclosed in the above patents merely as intermediates for conversion into more highly basic salts and complexes.

The oil-soluble basic salts and complexes are characterized by the presence therein of metal substantially in excess of one equivalent for each equivalent of acid. The commonly employed method for their preparation involves heating a solution of an organic acid compound in a substantially inert, normally liquid organic diluent such as mineral oil with a stoichiometric excess of an alkaline earth metal neutralizing agent such as the oxide, hydroxide, carbonate, bicarbonate, sulfide, hydrosulfide, amide or alkoxide (generally having an alkyl radical with about 7 or less carbon atoms) at a temperature above 50° C. and filtering the resulting mass. Barium, calcium and magnesium are the preferred alkaline earth metals, with the first two being most desirable from the standpoint of this method of preparing component C. A "promoter" is often used in the neutralization step to aid the incorporation of a large excess of metal. Examples of compounds useful as promoters include water (whose presence, usually in combination with other promoters, is generally required for the preparation of oil-soluble basic magnesium salts or complexes), phenolic compounds such as phenol, naphthol, alkylphenols, thiophenols, sulfurized alkylphenols, and condensation products of phenols with formaldehyde; alcohols such as methanol, 2-propanol, octyl alcohol, Cellosolve, Carbitol, ethylene glycol, stearyl alcohol and cyclohexyl alcohol; and amines such as aniline, phenylene diamine, phenothiazine, phenyl-$\beta$-naphthylamine and dodecylamine. For the purposes of this invention, it is preferred to further treat the basic compound prepared as described above with an acidic gas, especially carbon dioxide, in which case filtration is delayed until after carbonation is completed. Carbonation may be intermittent and followed by successive treatments with the metal neutralizing agent, and often enables the incorporation of still larger amounts of basic metal in the complex.

Examples of suitable acidic compounds for use in the preparation of the oil-soluble salt or complex are phenols, sulfonic acids, carboxylic acids and phosphorus acids. The word "phenol," as used herein, denotes any hydroxyaromatic compound including hydroxy compounds derived from fused-ring hydrocarbons (e.g., naphthols and the like). Especially preferred are phenols substituted with aliphatic or cycloaliphatic radicals having at least about 6 carbon atoms and up to as many as 7000 carbon atoms. Examples of such radicals are hexyl, cyclohexyl, heptyl, decyl, eicosyl, and radicals derived from the polymerization of olefins such as ethylene, propylene, 1-butene, 2-butene, isobutene and the like. Radicals derived from polymers of propylene and commercial mixtures of butenes (comprising predominantly isobutene) are preferred, especially those having a molecular weight of about 150–1750 (containing about 10–125 aliphatic carbon atoms). The substituent and the aryl nucleus of the phenol may contain other radicals such as hydroxy, nitro, nitroso and sulfo radicals.

Introduction of the aliphatic or cycloaliphatic substituent onto the phenol can be effected by mixing the hydrocarbon (or a halogenated derivative thereof, or the like) and the phenol at a temperature of about 50°–200° C. in the presence of a suitable catalyst, such as aluminum trichloride, boron trifluoride, zinc chloride or the like. The radical can also be introduced by other alkylation processes known in the art. It is irrelevant which position on the phenolic ring is substituted; any single isomer, or a mixture of isomers, may be used. Polysubstituted materials such as dialkyl and trialkyl phenols may also be present, either alone or in admixture with monoalkyl phenols.

Additional suitable phenols are polyphenols containing sulfur or alkylene bridges, typically prepared by reaction of a simple phenol with sulfur, a sulfur halide such as sulfur monochloride or dichloride, or a lower aliphatic aldehyde (preferably formaldehyde). Polyphenols containing both sulfur and alkylene bridges are also suitable.

The equivalent weight of a phenol for the purpose of this invention is its molecular weight divided by the number of phenolic hydroxy groups therein. Thus, the equivalent weight of phenol is equal to its molecular weight and that of an alkylated resorcinol is half its molecular weight.

The sulfonic acids suitable for use in the preparation of the oil-soluble salt or complex include those represented by the formulas $R^1(SO_3H)_r$ and $(R^2)_xT(SO_3H)_y$. In these formulas, $R^1$ is an aliphatic or aliphatic-substituted cycloaliphatic hydrocarbon-based radical free from acetylenic unsaturation and containing up to about 60 carbon atoms. When $R^1$ is aliphatic, it usually contains at least about 15–18 carbon atoms; when it is an aliphatic-substituted cycloaliphatic radical, the aliphatic substituents usually contain a total of at least about 12 carbon atoms. Examples of $R^1$ are alkyl, alkenyl and alkoxyalkyl radicals, and aliphatic-substituted cycloaliphatic radicals wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of $R^1$ are cetylcyclohexyl, laurylcyclohexyl, cetyloxyethyl, octadecenyl, and radicals derived from petroleum, saturated and unsaturated paraffin wax, and polyolefins, including polymerized monoolefins and diolefins containing about 1–8 carbon atoms per olefinic monomer unit.

As used hereinabove and elsewhere in the specification and claims, the term "hydrocarbon-based radical" denotes a radical having a carbon atom directly attached to the remainder of the molecule and having predominantly hydrocarbon character within the context of this invention. Such radicals include the following:

(1) Hydrocarbon radicals; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like, as well as cyclic radicals wherein the ring is completed through another portion of the molecule (that is, any two indicated substituents may together form an alicyclic radical).

(2) Substituted hydrocarbon radicals; that is, radicals containing non-hydrocarbon substituents which, in the context of this invention, do not alter the predominantly hydrocarbon character of the radical. Those skilled in the art will be aware of suitable substituents; examples include halo, nitro, nitroso, hydroxy, RO—, RS—, $$ROC(=O)- \quad \text{and} \quad RC(=O)-$$

(R being a hydrocarbon radical and especially a lower alkyl radical).

(3) Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based radical.

$R^2$ is generally a hydrocarbon-based radical free from acetylenic unsaturation and containing about 4–60 aliphatic carbon atoms, preferably an aliphatic hydrocarbon radical such as alkyl or alkenyl.

The radical T is a cyclic nucleus which may be derived from an aromatic hydrocarbon such as benzene, naphthalene, anthracene or biphenyl, or from a heterocylic compound such as pyridine, indole or isoindole. Ordinarily, T is an aromatic hydrocarbon nucleus, especially a benzene or naphthalene nucleus.

The subscript x is at least 1 and is generally 1–3. The subscripts r and y have an average value of about 1–4 per molecule and are generally also 1.

Illustrative sulfonic acids useful in the preparation of the oil-soluble salt or complex are mahogany sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl $\beta$-naphthol sulfonic acids, dicapryl nitronaphthalene sulfonic acids, paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, postdodecylbenzene sulfonic acids, "dimer alkylate" sulfonic acids, and the like. These sulfonic acids are well known in the art and require no further discussion herein.

For the purpose of this invention, the equivalent weight of a sulfonic acid is the molecular weight thereof divided by the number of sulfonic acid groups present therein. Thus, for a monosulfonic acid the equivalent weight is equal to the molecular weight.

Carboxylic acids suitable for use in the preparation of the oil-soluble salt or complex include aliphatic, cycloaliphatic and aromatic mono- and polybasic carboxylic acids free from acetylenic unsaturation, including naphthenic acids, alkyl or alkenyl-substituted cyclopentanoic acids, alkyl- or alkenyl-substituted cyclohexanoic acids, and alkyl- or alkenyl-substituted aromatic carboxylic acids. The aliphatic acids generally contain at least 8 and preferably at least 12 carbon atoms. The cycloaliphatic and aliphatic carboxylic acids can be saturated or unsaturated. Specific examples include 2-ethylhexanoic acid, linolenic acid, propylene tetramer-substituted maleic acid, behenic acid, stearic acid, isostearic acid, pelargonic acid, capric acid, palmitoleic acid, linoleic acid, lauric acid, oleic acid, ricinoleic acid, undecylic acid, dioctylcyclopentanecarboxylic acid, myristic acid, dilauryldecahydronaphthalenecarboxylic acid, stearyloctahydroindenecarboxylic acid, palmitic acid, acids formed by oxidation of petrolatum or of hydrocarbon waxes, and commercially available mixtures of two or more carboxylic acids such as tall oil acid, rosin acid, and the like. The equivalent weight of any such acid is its molecular weight divided by the number of carboxy groups present therein.

The phosphorus acids useful in the preparation of the oil-soluble salt or complex may contain pentavelent or trivalent phosphorus. The pentavalent phosphorus acids, which are preferred, may be represented by the formula

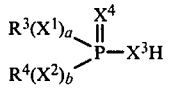

wherein each of $R^3$ and $R^4$ is hydrogen or a hydrocarbon-based radical, at least one thereof being hydrocarbon-based; each of $X^1$, $X^2$, $X^3$ and $X^4$ is oxygen or sulfur; and each of a and b is 0 or 1. Thus, it will be appreciated that the phosphorus acid may be an organophosphoric, phosphonic or phosphinic acid, or a thio analog of any of these.

Included among the suitable phosphorus acids are those prepared by the treatment of an olefin polymer (e.g., a polybutene having a molecular weight of about 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride.

The equivalent weight of a phosphorus acid is its molecular weight divided by the number of hydroxy groups bonded to phosphorus therein.

The preferred organic acidic compounds for use in the preparation of the oil-soluble salt or complex are the above-described sulfonic and carboxylic acids, especially those having an equivalent weight of about 300–500. The sulfonic acids are most often used, and a particular preference is expressed for alkylaromatic sulfonic acids and more particularly for alkylbenzene sulfonic acids.

The metal content of the oil-soluble salt or complex is conveniently denoted by the "metal ratio," which is defined as the ratio of equivalents of metal in the salt or complex to equivalents of anion of the orgaic acid therein. Thus, a neutral salt prepared from one equivalent of metal neutralizing agent and one equivalent of organic acid has a metal ratio of 1, while a basic salt containing two equivalents of metal per equivalent of organic acid has a metal ratio of 2. For the preparation of the non-Newtonian complex, oil-soluble salts and complexes having a metal ratio of at least about 3.5 and preferably at least about 4.5 are most often used.

The oil-soluble basic metal salt or complex is converted to the non-Newtonian complex useful as component C by treating it with a "conversion agent" as described in the aforementioned U.S. Pat. Nos. 3,312,618 and 3,492,231, which patents provide full description and many illustrative examples of the method of preparation. Suitable conversion agents include carbon dioxide and various active hydrogen compounds such as water, lower aliphatic carboxylic acids, alcohols, phenols, ketones, aldehydes, amines, boron acids and phosphorus acids. Particularly preferred conversion agents are water and lower alkanols, either alone or in combination with carbon dioxide.

A second method for preparing non-Newtonian complexes useful as component C is described in the aforementioned U.S. Pat. No. 4,094,801. According to this method, a magnesium base (i.e., magnesium oxide, magnesium hydroxide, hydrated magnesium oxide, a magnesium alkoxide, or a mixture of these) is combined with at least one oleophilic organic reagent, water and an organic solubilizing agent, the amount of magnesium being such as to provide a metal ratio of at least about 5:1. The suitable oleophilic organic reagents are the carboxylic acids, sulfonic acids and pentavalent phosphorus acids described hereinabove in connection with the preparation of oil-soluble metal salts and complexes, as well as esters and alkali metal and alkaline earth metal salts of the same. The organic solubilizing agent is for the most part identical with the substantially inert, normally liquid organic diluent previously described. Carbon dioxide or other acidic gases are not used in the preparation of these magnesium complexes.

The relative proportions of the various ingredients, especially the diluent, may be adjusted so as to obtain thickened compositions (i.e., thickened liquids or greases) which may be used as component C. These thickened basic magnesium complexes are preferred for use as component C in the present invention.

Especially preferred are non-Newtonian, basic complexes prepared by the reaction of magnesium oxide or hydroxide with a ($C_{4-60}$ alkyl) benzenesulfonic acid, a $C_{12-20}$ carboxylic acid, of (most often) a mixture of these. The aforementioned U.S. and German applications provide full descriptions and illustrative examples of the preparation of these and other suitable basic magnesium complexes.

The compositions of this invention usually contain graphite (component B) in the amount of about 10–25% by weight, preferably about 12–20%. Component C, as previously noted, is present in amounts of about 5–25% by weight. This percentage of component C is based on the presence of inorganic components and non-volatile acidic materials (such as sulfonates and/or carboxylates) therein and does not include diluent which is merely present as such. Thus, for example, a non-Newtonian composition comprising water, bright stock, a petroleum sulfonic acid and hydrated magnesium oxide will be considered, for the purpose of computing the amount thereof in the composition of this invention, as comprising entirely the sulfonic acid and magnesium oxide or hydroxide; the water and bright stock will be disregarded.

The compositions of this invention may be prepared by merely blending components A, B and C at a suitable temperature, usually within the range of about 50°–125° C., to form a stable suspension. Volatile materials may be removed by heating under vacuum or the like. It is often advantageous to add components A and B to component C immediately after preparation of the latter. The liquid product thus obtained is the desired composition which is itself non-Newtonian, usually thixotropic. As previously noted, components B and C are stably suspended in component A; by "stably suspended" is meant that minimal settling occurs after several days of storage at normal ambient temperatures, typically room temperature. There is, of course, some tendency for settling which can be appreciable if storage is continued for several weeks or if the composition is subjected to high temperatures. However, it is possible to resuspend the components of the composition by merely agitating the same and storing again at room temperature.

The preparation of the compositions of this invention is illustrated by the following examples.

EXAMPLE 1

A calcium petroleum sulfonate is obtained by reacting a solution of 1000 parts of a sodium petroleum sulfonate in 304 parts of mineral oil, said solution having a sulfated ash content of about 8.5, with 71.3 parts of calcium chloride, 2.9 parts of lime and 84 parts of water. To 1600 parts of the calcium sulfonate thus obtained is added 1480 parts of bright stock to form a solution.

A 2320-part portion of the calcium petroleum sulfonate solution is charged to a paddle mixer and there are added 608 parts of lime, 119 parts of methanol, 82 parts of water, 1190 parts of heptane and 412 parts of bright stock. Mixing is commenced at 65° C. and is continued for about ½ hour. Heating and mixing are continued as carbon dioxide is blown through the mixture at 65°–72° C. for about 6 hours. Volatile materials are then purged by blowing with nitrogen at 150°–160° C. Upon cooling to room temperature, a grease is obtained.

To 1000 parts of the above grease is added 1000 parts of bright stock and 272 parts of graphite. The resulting thixotropic liquid contains 12% graphite and 17.6% of the calcium sulfonate complex.

EXAMPLE 2

A paddle mixer is charged with 1000 parts of bright stock, 138 parts of magnesium oxide, 53 parts of "Hydrex 440" (a mixture of hydrogenated fatty acids obtainable from Union Camp Corporation), and 14 parts of an alkylbenzenesulfonic acid having an equivalent weight of about 430 and containing about 22% unsulfonated alkylbenzene. After mixing for 1 hour at 88°–91° C., 60 parts of water is added over 2 hours in the same temperature range. Heating is continued for an additional 2 hours after which volatile materials are removed by heating to 130°–132° C. The mixture is then cooled to about 40° C. and 206 parts of graphite is added to yield the desired thixotropic liquid.

EXAMPLE 3

A mixture of 7500 parts of a 650 neutral mineral oil, 1235 parts of magnesium oxide, 565 parts of "Hydrex 440" and 150 parts of the alkylbenzenesulfonic acid of Example 2 is heated to 90° C. and 295 parts of water is added over 2½ hours, with stirring. The mixture is then heated for 1 hour at 100° C. and cooled to 45°–50° C. An additional 10,930 parts of 650 neutral oil and 4032 parts of graphite are added and the mixture is screened to yield the desired composition as a thixotropic black liquid.

EXAMPLE 4

A mixture of 1300 parts of a 200 neutral mineral oil, 247 parts of magnesium oxide, 113 parts of "Hydrex 440" and 30 parts of the alkylbenzenesulfonic acid of Example 2 is heated to 85°–90° C. with stirring, and 59 parts of water is added over 2 hours. The mixture is heated to 100° C. and stirred for one hour and then cooled to 50° C. as an additional 341 parts of 200 neutral oil is added. Finally, 410 parts of graphite is added and the resulting thixotropic product is stirred at 50° C. for 30 minutes.

The compositions of Examples 1–4 may be used as lubricants for hot forging by applying a lubricating amount thereof to the forging die by manual application, spraying, or equivalent means just prior to the insertion of the workpiece therein. All provide adequate lubrication so as to avoid welding or scoring of the die under forging conditions. All are characterized by relatively low evolution of smoke. It is also often found that the forging lubricants of the present invention may contain substantially less graphite than those previously known; for example, many forging lubricants contain at least 22–23% graphite while amounts as low as 14% may be adequate in the compositions of this invention. It is believed that the decrease in amount of graphite necessary is due to some interaction between the graphite and the non-Newtonian basic alkaline earth metal complex.

What is claimed is:

1. A composition comprising (A) a substantially inert, relatively non-volatile, normally liquid aliphatic or alicyclic organic diluent and, dissolved or stably suspended therein, (B) graphite and (C) at least one non-Newtonian basic alkaline earth metal complex; component B comprising up to about 25% and component C about 5–25% by weight of said composition.

2. A composition according to claim 1 wherein the alkaline earth metal in component C is magnesium.

3. A composition according to claim 2 wherein component A is non-polar and has a flash point above about 150° C. as measured by the Cleveland Open Cup method.

4. A composition according to claim 3 wherein component C is prepared by the reaction of magnesium oxide or hydroxide with a mixture of an alkylbenzenesulfonic acid and a $C_{12-20}$ carboxylic acid and has a magnesium ratio of at least about 5:1.

5. A composition according to claim 4 which contains about 12–20% of component B.

6. A composition according to claim 5 wherein component A is a mineral oil.

7. A composition according to claim 6 wherein component A has a 50% distillation point at 1 torr above about 220° C.

8. A composition according to claim 7 wherein component A is bright stock, 200 to 650 Neutral mineral oil, or a mixture thereof.

9. A composition according to claim 1 wherein the alkaline earth metal in component C is calcium.

10. A composition according to claim 9 wherein component A is non-polar and has a flash point above about 150° C. as measured by the Cleveland Open Cup method.

11. A composition according to claim 10 which contains about 12–20% of component B.

12. A composition according to claim 11 wherein component A is a mineral oil.

13. A composition according to claim 12 wherein component A has a 50% distillation point at 1 torr above about 220° C.

14. A composition according to claim 13 wherein component A is bright stock, 200 to 650 neutral mineral oil, or a mixture thereof.

15. In a method for forging metal which includes the step of applying a lubricant to the forging die, the improvement which comprises using as the lubricant a composition according to claim 1.

16. In a method for forging metal which includes the step of applying a lubricant to the forging die, the improvement which comprises using as the lubricant a composition according to claim 2.

17. In a method for forging metal which includes the step of applying a lubricant to the forging die, the improvement which comprises using as the lubricant a composition according to claim 4.

18. In a method for forging metal which includes the step of applying a lubricant to the forging die, the improvement which comprises using as the lubricant a composition according to claim 6.

19. In a method for forging metal which includes the step of applying a lubricant to the forging die, the improvement which comprises using as the lubricant a composition according to claim 8.

20. In a method for forging metal which includes the step of applying a lubricant to the forging die, the improvement which comprises using as the lubricant a composition according to claim 9.

21. In a method for forging metal which includes the step of applying a lubricant to the forging die, the improvement which comprises using as the lubricant a composition according to claim 11.

22. In a method for forging metal which includes the step of applying a lubricant to the forging die, the improvement which comprises using as the lubricant a composition according to claim 12.

23. In a method for forging metal which includes the step of applying a lubricant to the forging die, the improvement which comprises using as the lubricant a composition according to claim 14.

* * * * *